United States Patent [19]

Tatemasu et al.

[11] Patent Number: 4,912,305

[45] Date of Patent: Mar. 27, 1990

[54] SILICON NITRIDE BASE CERAMIC HEATER ELEMENT AND METHOD OF PRODUCING SAME

[75] Inventors: Kazuho Tatemasu; Yukihiro Kimura; Yoshiro Noda, all of Aichi, Japan

[73] Assignee: NGK Spark Plug Co., Ltd., Nagoya, Japan

[21] Appl. No.: 357,786

[22] Filed: May 30, 1989

[30] Foreign Application Priority Data

Jun. 9, 1988 [JP] Japan ..... 63-141997

[51] Int. Cl.[4] ..... H05B 3/12

[52] U.S. Cl. ..... 219/544; 219/553; 219/270; 501/97; 501/98; 123/145 A

[58] Field of Search ..... 219/270, 552, 553, 544; 29/611; 123/145 A, 145 R; 501/97, 98

[56] References Cited

U.S. PATENT DOCUMENTS

| | | | |
|---|---|---|---|
| 4,486,651 | 12/1984 | Atsumi et al. | 219/553 |
| 4,499,192 | 2/1985 | Shimamori et al. | 501/97 |
| 4,556,780 | 12/1985 | Atsumi et al. | 219/544 |
| 4,598,676 | 7/1986 | Ito | 219/553 |
| 4,633,064 | 12/1986 | Atsumi | 219/553 |
| 4,634,837 | 1/1987 | Ito | 219/553 |
| 4,733,056 | 3/1988 | Kojima | 219/544 |

*Primary Examiner*—Bruce A. Reynolds
*Assistant Examiner*—Leon K. Fuller
*Attorney, Agent, or Firm*—Foley & Lardner, Schwartz, Jeffery, Schwaab, Mack, Blumenthal & Evans

[57] ABSTRACT

The invention relates to a ceramic heater element consisting of a sintered body of a silicon nitride base ceramic and a resistance heating wire such as a tungsten wire embedded in the ceramic body. The ceramic contains $Al_2O_3$ and AlN besides $Si_3N_4$ and is produced by using $Y_2O_3$ as sintering aid. The ceramic body is improved in strength and also in stability of the ceramic structure at temperatures up to about 1300° C. by rendering the grain boundary phase of the sintered ceramic a crystalline phase comprising either $2Y_2O_3.Si_{2-x}Al_xN_{2-x}O_{1-x}$ ($0 \leqq x < 2$) or $3Y_2O_3.5Al_2O_3$. The heater element is produced by preparing a powder mixture in which ($Si_3N_4+Al_2O_3+AlN$) amounts to 90–98 wt %, the balance being the sintering aid, with proviso that ($Al_2O_3+AlN$)/$Si_3N_4$ is from 0.02 to 0.08 by weight and that ($Al_2O_3$/AlN) is from 0.2 to 2.0 by weight, compacting the powder mixture into a desirably shaped body with insertion of the heating wire and sintering the shaped body preferably by a hot press sintering method. For example, the heater element is used in a glow plug for a diesel engine.

8 Claims, 3 Drawing Sheets

EXAMPLE 1

EXAMPLE 4

COMPARATIVE EXAMPLE 1

SILICON NITRIDE BASE CERAMIC HEATER ELEMENT AND METHOD OF PRODUCING SAME

BACKGROUND OF THE INVENTION

This invention relates to a heater element consisting of a sintered body of a silicon nitride base ceramic and a resistance heating wire embedded in the ceramic body and a method of producing same.

In some of conventional ceramic heater elements a silicon nitride base ceramic is used as the material of the heater element body and a high melting point metal such as tungsten as the material of the resistance heating wire.

However, the silicon nitride base ceramic heater elements developed until now have a problem that in the sintered ceramic the grain boundary phase is a sort of glass phase which begins to soften as the temperature of the resistance heating wire in the ceramic body rises to about 1000° C. by the flow of a current in the wire whereby the ceramic body lowers in mechanical strength, in particular in transverse strength. When a heater element using a silicon nitride base ceramic having such a grain boundary phase is operated with a DC voltage, as in the case of the heater element of a glow plug for a diesel engine, there arises another problem. That is, if the heater element is energized continuously or intermittently to reach a temperature above 1200° C. the application of the DC voltage causes migration of ions in the grain boundary glass phase, and hence the structure of the ceramic body deteriorates with vacant holes created in a region near the positive terminal and microcracks in a region near the negative terminal. Consequently the heater element is liable to suffer from lowering of the strength of the ceramic body and/or breaking of the resistance heating wire. For these reasons the upper boundary of practical operational temperatures of the conventional ceramic heater elements is about 1150° C.

SUMMARY OF THE INVENTION

It is an object of the present invention to provide a silicon nitride base ceramic heater element in which the sintered ceramic body has an improved grain boundary phase and retains high strength and good stability up to a temperature of about 1300° C. or above.

It is another object of the invention to provide a method of producing a ceramic heater element according to the invention.

A ceramic heater element according to the invention comprises a body of a sintered silicon nitride ($Si_3N_4$) base ceramic, which contains small amounts of aluminum oxide and aluminum nitride and is produced by using yttrium oxide as a sintering aid, and a resistance heating wire embedded in the ceramic body, and the ceramic heater element is characterized in that in the sintered silicon nitride base ceramic the grain boundary phase is a crystallized phase which comprises a secondary phase represented by $2Y_2O_3Si_{2-x}Al_xN_{2-x}O_{1-x}$, wherein $0 \leqq x < 2$, or by $3Y_2O_3 . 5Al_2O_3$.

Needless to mention the primary phase of the sintered ceramic is a crystalline silicon nitride phase which constitute the grains.

As to the material of the resistance heating wire, it is preferred to use a high melting point metal selected from tungsten, molybdenum and rhenium, and their alloys and mixtures, or a carbide of any of these metals.

According to the invention a ceramic heater element is produced by a method comprising the steps of mixing a $Si_3N_4$ powder with an $Al_2O_3$ powder, an AlN powder and a sintering aid comprising a $Y_2O_3$ powder to obtain a powder mixture in which the total of $Si_3N_4$, $Al_2O_3$ and AlN amounts to 90–98 wt % with proviso that the ratio $(Al_2O_3+AlN)/Si_3N_4$ is in the range from 0.02 to 0.08 by weight and the ratio $Al_2O_3/AlN$ is in the range from 0.2 to 2.0 by weight, compacting the powder mixture into a desirably shaped body with insertion of a resistance heating wire to embed it in the shaped body and sintering the shaped body in a nonoxidizing atmosphere at a temperature in the range from 1600° to 2100° C.

Preferably the sintering of the compacted powder mixture is performed by hot press sintering. A post-sintering heat treatment may be made to accomplish the desired crystallization of the grain boundary phase.

$Y_2O_3$ is a sintering aid indispensable to the present invention. Usually it suffices to use $Y_2O_3$ alone as the sintering aid, but it is optional to use at least one other rare earth element oxide together with $Y_2O_3$. It is necessary that the sintering aid occupies at least 2 wt % of the aforementioned powder mixture for affording good sinterability to the mixture, but it is undesirable that the sintering aid occupied more than 10 wt % of the mixture because then it becomes difficult to crystallize the grain boundary phase of the sintered ceramic.

If the weight ratio of $(Al_2O_3+AlN)$ to $Si_3N_4$ is above 0.08 the sintered ceramic is insufficient in oxidation resistance and transverse strength. If this ratio is below 0.02 the powder mixture is inferior in sinterability. If the weight ratio of $Al_2O_3$ to AlN is above 2.0 or below 0.2 it is difficult to desirably crystallize the grain boundary phase of the sintered ceramic.

By virtue of the crystallization of the grain boundary phase of the sintered ceramic a heater element according t the invention has advantages mainly in the following respects.

The sintered ceramic body has sufficiently high strength up to a temperature of about 1350° C. since the grain boundary phase does not turn into a liquid phase even at high temperatures. The operation of the heater element with a DC voltage hardly causes migration of ions in the sintered ceramic including the grain boundary phase and, hence, rarely causes deterioration of the structure of the sintered ceramic body, because every element of the ceramic composition stably exists in crystals. The sintered ceramic body is excellent in oxidation resistance since even at very high temperatures there is no possibility of diffusion of oxygen in the ceramic body through a liquid phase.

The crystallized grain boundary phase comprises a secondary phase represented by $2Y_2O_3.Si_{2-x}Al_xN_{2-x}O_{1-x}$ $(0 \leqq x < 2)$ or $3Y_2O_3.5Al_2O_3$. Accordingly the grain boundary phase is very high in melting point and very small in the amount of a change in volume by oxidation, and the aforementioned merits of the crystallization of the grain boundary phase are further augmented.

Heater elements according to the invention are useful in various heating devices and apparatus such as glow plugs, wide-purpose electric heaters, electric ovens and furnaces, room or spot heaters, electric cooking utensil, etc.

DESCRIPTION OF THE PREFERRED EMBODIMENTS

Figure 1:
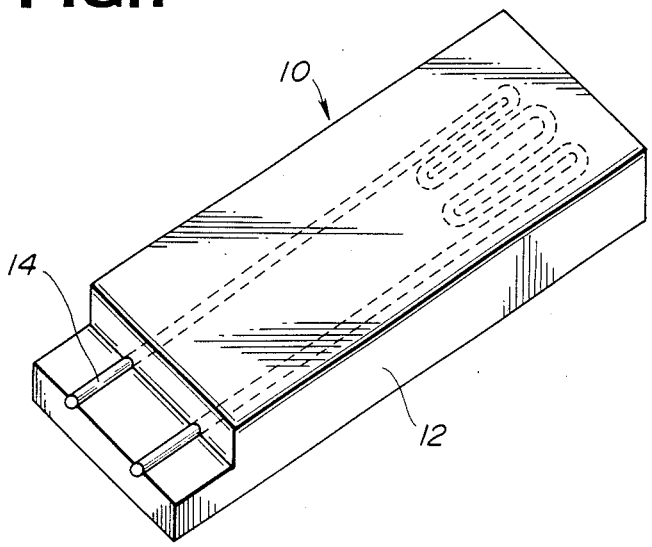
FIG. 1 is a perspective view of a heater element according to the invention.

FIG. 1 shows a ceramic heater element 10 according to the invention. The heater element 10 consists of a sintered body 12 of a silicon nitride base ceramic and a resistance heating wire 14 embedded in the ceramic body 12. The shape of the ceramic body 12 and the pattern of disposition of the wire 14 in the ceramic body 12 are arbitrary.

The material of the resistance heating wire 14 must have a melting point higher than the temperature at which the ceramic body 12 is sintered. As the heating wire material it is preferred to use any of tungsten, molybdenum and rhenium and their alloys, or a carbide of any of these three metals, and it is also possible to use a mixture of one of these three metals with at least one of the others and/or at least one of the carbides of the three metals.

The body 12 of the heater element 10 is formed of a sintered silicon nitride base ceramic which contains small amounts of aluminum oxide and aluminum nitride and is produced always by using yttrium oxide as sintering aid, as described hereinbefore. $La_2O_3$ and $CeO_2$ are good examples of rare earth element oxides any of which may optionally be used together with $Y_2O_3$. In the sintered ceramic the grain boundary phase is a crystallized phase comprising either $2Y_2O_3.Si_{2-x}Al_xN_{2-x}O_{1-x}$ ($0 \leqq x < 2$) or $3Y_2O_3.5Al_2O_3$.

As is usual, the heater element 10 is produced by the steps of preparing a powder mixture of the raw materials of the silicon nitride base ceramic, compacting the powder mixture in a mold with insertion of the resistance heating wire 14, and sintering the molded body in a nonoxidizing atmosphere preferably by a hot press sintering method.

Figure 2:
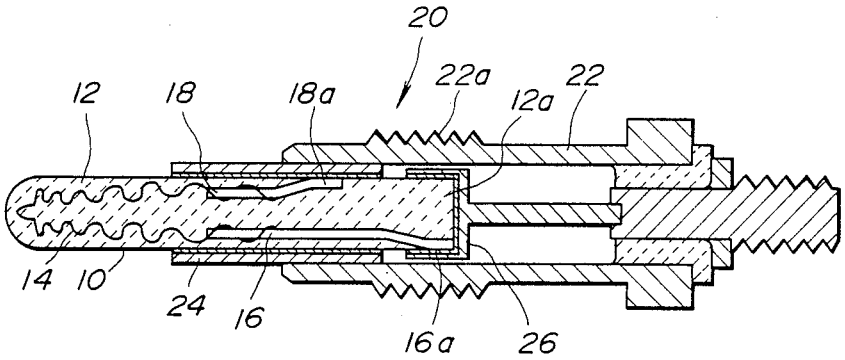
FIG. 2 is a longitudinal sectional view of a glow plug using a heater element according to the invention.

FIG. 2 shows a glow plug 20 for a diesel engine. The glow plus 20 uses a ceramic heater element 10 embodying the invention. The sintered ceramic body 12 of the heater element 10 has a solid cylindrical shape, and a resistance heating wire 14 is embedded in the ceramic body 12 in a roughly U-shaped pattern (in longitudinal sections of the body 12). In the ceramic body 12 the opposite end portions of the wire 14 are fixed to first and second metal strips 16 and 18 used as terminals, respectively.

The main body of the glow plug 20 is a tubular metal shell 22 with thread **22*a* on the outer surface. A metal sleeve 24 is partly fitted into a fore end portion of the shell 22, and an axially middle part of the ceramic body 12 is fitted in the metal sleeve 24. The terminal 18 embedded in the ceramic body 12 has an exposed surface 18*a* in its aft end portion, and the exposed surface 18*a* is connected to the inner surface of the metal sleeve 24 by soldering. A metal cap 26 is inserted into the metal shell 22 from its aft end and fitted around an aft end portion 12*a* of the ceramic body 12. The terminal 16 embedded in the ceramic body 12 has an exposed surface 16*a* in its aft end portion, and the exposed surface 16*a* is connected to the inner surface of the metal cap 26 by soldering. The outer surface of the end portion 12*a* of the ceramic body is also soldered to the metal cap 26. The metal cap 26 serves as a center electrode to be connected with the positive terminal of a DC power supply, whereas the metal shell 22** is to be connected with the negative terminal.

EXAMPLES 1-6

In these examples of the invention, samples of the ceramic heater element 10 of the glow plug 20 of FIG. 2 were produced by varying the composition of the ceramic within the limitations according to the invention.

In every example the raw materials of the ceramic were powders of $Si_3N_4$, $Al_2O_3$, AlN and $Y_2O_3$, and every powder had a mean particle size of about 1.0 μm. The resistance heating wire 14 was a coiled tungsten wire having a diameter of 0.2 mm. The $Si_3N_4$, $Al_2O_3$, AlN and $Y_2O_3$ powders were mixed in the proportions shown in Table 1, and the powder mixture was wetted with ethanol and thoroughly mixed in a ball mill for 24 hr. After that the wet mixture was dried to obtain a dry powder mixture. The thus prepared powder mixture was compacted in a mold in which the tungsten wire 14 was inserted. The powder mixture in the mold was subjected to hot press sintering in a nonoxidizing atmosphere at a temperature of 1700° C. and under a pressure of 300 kg/cm$^2$. The sintering temperature and pressure were maintained for 30 min.

Figure 3:
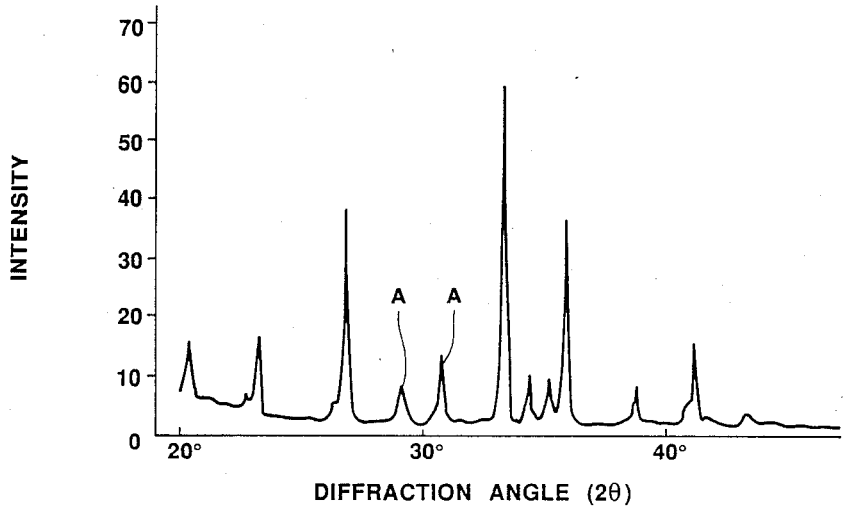
FIGS. 3 and 4 are charts showing X-ray diffraction patterns of the sintered ceramics in two examples of the invention, respectively.
Figure 4:
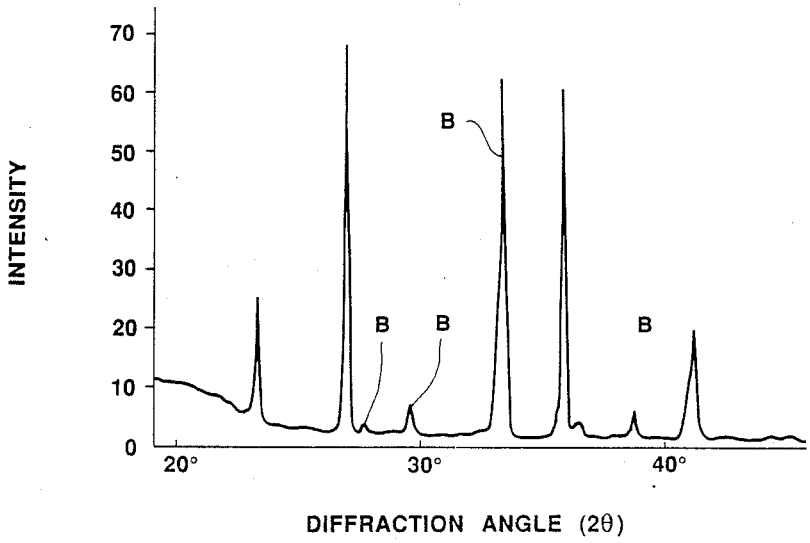

In the silicon nitride base ceramics of the heater elements 10 produced in Examples 1-4 and 6, the grain boundary phase comprised a secondary phase represented by $2Y_2O_3.Si_{2-x}Al_xN_{2-x}O_{1-x}$ ($0 \leqq x < 2$), which is indicated by the symbol (A) in Table 1. FIG. 3 shows the X-ray diffraction pattern of the ceramic of Example 2. The peaks A indicate a $2Y_2O_3.Si_{2-x}Al_xN_{2-x}O_{1-x}$ phase. In the silicon nitride base ceramic of Example 5 the grain boundary phase comprised a secondary phase represented by $3Y_2O_3.5Al_2O_5$, which is indicated by (B) in Table 1. FIG. 4 shows the X-ray diffraction pattern of this ceramic. The peaks B indicate the $3Y_2O_3.5Al_2O_3$ phase.

The ceramic heater elements 10 produced in these examples were subjected to the evaluation tests described hereinafter.

COMPARATIVE EXAMPLES 1-6

Also in these comparative examples samples of the ceramic heater elements 10 in FIG. 2 were produced by the same method as in Examples 1-6, except that the proportions of the raw materials were varied as shown in Table 1.

In the sintered silicon nitride base ceramics of Comparative Examples 1-6 the grain boundary phase comprised a crystalline secondary phase represented by $Si_3N_4.Y_2O_3$ ((C) in Table 1), $2Si_3N_4.La_2O_3$ ((D) in Table 1) or $CeSiO_2N$ ((E) in Table 1 or a noncrystalline phase (a sort of glass phase: (F) in Table 1).

The heater elements of Comparative Examples 1-6 were also subjected to the aforementioned tests.

TABLE 1

| | Composition (wt %) | | | | $(Al_2O_3 + AlN)$ / $Si_3N_4$ | $Al_2O_3$ / AlN | Grain Boundary Phase (Secondary Phase) |
|---|---|---|---|---|---|---|---|
| | $Si_3N_4$ | $Al_2O_3$ | AlN | $Y_2O_3$ | | | |
| Ex. 1 | 94 | 0.5 | 1.5 | 4 | 0.021 | 0.33 | (A) |
| Ex. 2 | 92 | 1 | 3 | 4 | 0.043 | 0.33 | (A) |
| Ex. 3 | 91 | 1 | 4 | 4 | 0.055 | 0.25 | (A) |
| Ex. 4 | 92 | 2 | 2 | 4 | 0.043 | 1 | (A) |
| Ex. 5 | 91 | 2 | 5 | 2 | 0.077 | 0.4 | (B) |
| Ex. 6 | 92 | 2.5 | 1.5 | 4 | 0.043 | 1.67 | (A) |
| Comp. Ex. 1 | 90 | 4 | — | 6 | 0.044 | — | (F) |
| Comp. Ex. 2 | 85 | 1 | 3 | 12 | 0.046 | 0.33 | (C) |
| Comp. Ex. 3 | 91 | 3 | 1 | 5 | 0.044 | 3 | (F) |
| Comp. Ex. 4 | 90 | 5 | 2.5 | 2.5 | 0.083 | 2 | (F) |
| Comp. Ex. 5 | 91 | — | 1 | 4[1] | 0.011 | — | (D) |
| Comp. Ex. 6 | 91 | — | 1 | 4[2] | 0.011 | — | (E) |

[1] $La_2O_3$ 4 wt % in addition to $Y_2O_3$
[2] $CeO_2$ 4 wt % in addition to $Y_2O_3$

EVALUATION TESTS

Transverse Strength

The samples of the heater elements 10 for testing of transverse strength were produced without embedding the wire 14. The sintered ceramic bodies were worked with a diamond grinder to obtain test pieces 4 mm in width, 40 mm in length and 3 mm in thickness. The transverse strength of each test piece was measured by the three-point flexural testing method with a span of 30 mm. The speed of the cross-head was 0.5 mm/min. The testing was made in the air at room temperature, at 1000° C. and at 1300° C. The results are shown in Table 2A. As can be seen, the sintered ceramics according to the invention retained sufficiently high strength even at 1300° C. and, in this regard, were remarkably superior to the sintered ceramics of Comparative Examples.

Oxidation Resistance Test

The samples of the heater elements 10 for this test were produced without embedding the wire 14.

Each sample was weighed precisely and then left standing in the air at a temperature of 1000° C. or 1300° C. for 100 hr. After that the sample was weighed to determine the amount of an increase in weight by the heat treatment. The oxidation resistance was evaluated in terms of the amount of increase in weight per unit surface area of the sintered ceramic body ($mg/cm^2$). The results are shown in Table 2A. As can be seen, the sintered ceramics according to the invention were remarkably better than the sintered ceramics of Comparative Examples in oxidation resistance at high temperatures, in particular at 1300° C.

Operational Endurance Test

A pair of electrodes for testing were attached to the two terminals 16 and 18 of the ceramic heater element 10, respectively, and the heater element was operated with a DC voltage controlled such that the saturation temperature became 1200° C. The operation was continued for 1 min and then interrupted for 1 min. During the interruption period air was blown against the heater element to rapidly cool it. The operating and cooling process was repeated 10000 times. For the heater element of every example and comparative example, the test was made on five samples. After the test, the endurance of each sample was evaluated by measuring the amount of increase in the electric resistance of the heating wire 14. Furthermore, the tested samples were ground with a diamond grinder until the wire 14 was exposed, and the section of the sintered ceramic body 12 was carefully observed to judgh whether the operational endurance test caused deterioration of the structure of the sintered ceramic in the vicinity of the wire 14. In respect of the degree of deterioration of the structure of the ceramic, the tested heater elements were ranked in the following four grades.

A: no deterioration
B: slight deterioration
C: some deterioration
D: serious deterioration On another five samples of the heater element of every example and comparative example, the above operational endurance test was made by raising the saturation temperature to 1300° C., and the tested samples were examined in the above described manners.

The results of the operational endurance test are shown in Table 2B As can be seen, the heater elements according to the invention passed the operational endurance test (10000 cycles) with no change, or with only less than 5% change, in the electrical resistance of the embedded wire 14, and without significant deterioration of the structure of the sintered ceramic even in the vicinity of the heating wire 14.

TABLE 2A

| | Transverse Strength ($kg/mm^2$) | | | Wt. Increase by Oxidation ($mg/cm^2$) | |
|---|---|---|---|---|---|
| | room temp. | 1000° C. | 1300° C. | 1000° C. | 1300 20 C. |
| Ex. 1 | 95 | 73 | 57 | 0.04 | 0.3 |
| Ex. 2 | 107 | 88 | 84 | 0.03 | 0.5 |
| Ex. 3 | 106 | 88 | 70 | 0.05 | 0.6 |
| Ex. 4 | 112 | 86 | 71 | 0.02 | 0.5 |
| Ex. 5 | 101 | 78 | 52 | 0.06 | 0.8 |
| Ex. 6 | 110 | 74 | 62 | 0.04 | 0.8 |
| Comp. Ex. 1 | 92 | 55 | 25 | 0.03 | 1.4 |
| Comp. Ex. 2 | 97 | 67 | 43 | 0.50 | 1.5 |
| Comp. Ex. 3 | 91 | 75 | 38 | 0.03 | 0.7 |
| Comp. Ex. 4 | 102 | 51 | 32 | 0.09 | 1.3 |
| Comp. Ex. 5 | 98 | 77 | 48 | 0.12 | 1.7 |
| Comp. Ex. 6 | 94 | 75 | 46 | 0.22 | 1.8 |

TABLE 2B

| | Operational Endurance Test | | Deterioration of |
|---|---|---|---|
| | saturat. temp. 1200° C. | saturat. temp. 1300° C. | Structure after Testing |
| Ex. 1 | no change in resistance | 3-5% increase in resistance | B |
| Ex. 2 | no change in resistance | no change in resistance | A |
| Ex. 3 | no change in resistance | no change in resistance | A |
| Ex. 4 | no change in resistance | no change in resistance | A |
| Ex. 5 | no change in resistance | 1-3% increase in resistance | A |
| Ex. 6 | no change in resistance | no change in resistance | A |
| Comp. Ex. 1 | 5-20% increase in resistance | wire breaking[1] | D |
| Comp. Ex. 2 | wire breaking[2] | wire breaking[1] | D |
| Comp. Ex. 3 | 5-10% increase in resistance | 20-40% increase in resistance | C |
| Comp. Ex. 4 | 5-10% increase in resistance | 20-40% increase in resistance | C |
| Comp. Ex. 5 | 20-30% increase in resistance | wire breaking[1] | D |
| Comp. Ex. 6 | 20-30% increase in resistance | wire breaking[1] | D |

Figure 6:
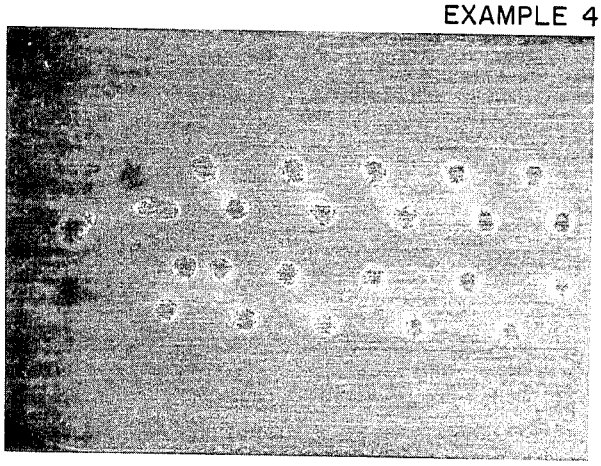
Figure 7:
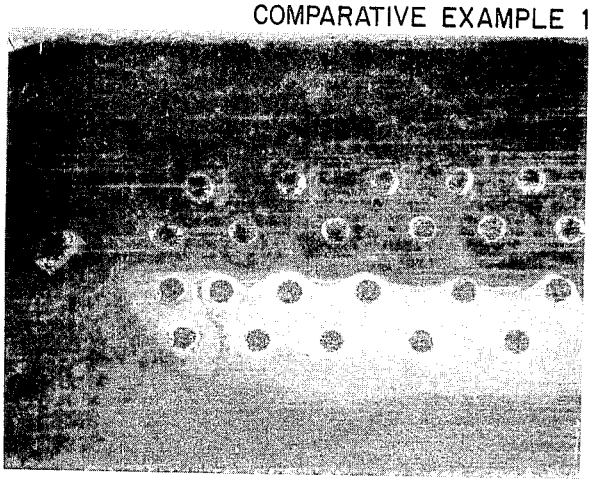
FIG. 7 is a micrograph of a section of a heater element not in accordance with the invention which was subjected to the operational endurance test.

[1]breaking of wire before repeating operation 1000 times
[2]breaking of wire while repeating operation 3000-7000 times FIG. 6 is a micrograph (magnification: 20×) of a section of the heater element 10 of Example 1 subjected to the operational endurance test, and FIGS. 6 and 7 are similar micrographs showing the heater elements of Example 4 and Comparative Example 1, respectively. In every micrograph, the lower part of the heating wire 14 was connected with the positive terminal of the DC power supply in the test and the upper part with the negative terminal.

Figure 5:
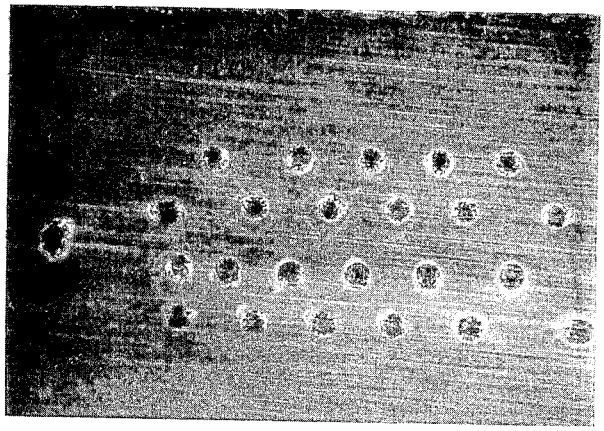
FIGS. 5 and 6 are respectively micrographs of sections of two heater elements embodying the invention which were subjected to an operational endurance test.

FIG. 5 shows that narrow gaps appeared between the ceramic and the heating wire in the tested sample of the heater element of Example 1 (endured 10000 cycles of the operating and cooling process), which should be taken as slight deterioration of the structure of the ceramic. FIG. 6 shows that in the tested sample of the heater element of Example 4 (endured 10000 cycles of the operating and cooling process) deterioration of the structure of the ceramic was inappreciable. FIG. 7 shows the manner of deterioration of the structure of the ceramic in the sample of the heater element of Comparative Example 1, in which breaking of the wire occurred when the operating and cooling process was repeated 850 times.

What is claimed is:

1. A ceramic heater element, comprising:

a body of a sintered silicon nitride base ceramic which comprises $Al_2O_3$ and AlN in addition to $Si_3N_4$ and is produced by using a sintering aid comprising $Y_2O_3$; and a resistance heating wire embedded in the sintered ceramic body;

in the sintered silicon nitride base ceramic the grain boundary phase of the silicon nitride base ceramic is a crystallized phase comprising a phase represented by the general formula $2Y_2O_3.Si_{2-x}Al_xN_{2-x}O_{1-x}$, wherein $0 \leqq x < 2$, or by $3Y_2O_3.5Al_2O_3$.

2. A ceramic heater element according to claim 1, wherein the ratio of $(Al_2O_3+AlN)$ to $Si_3N_4$ in the silicon nitride base ceramic is in the range from 0.02 to 0.08 by weight with proviso that the ratio of $Al_2O_3$ to AlN is in the range from 0.2 to 2.0 by weight, the weight ratio of $(Si_3N_4+Al_2O_3+AlN)$ to said sintering aid being in the range from 98:2 to 90:10.

3. A ceramic heater element according to claim 2, wherein said sintering aid further comprises at least one other rare earth element oxide.

4. A ceramic heater element according to claim 1, wherein the material of said heating wire is selected from the group consisting of tungsten, molybdenum and rhenium, and their alloys and mixtures, tungsten carbide, molybdenum carbide and rhenium carbide.

5. A method of producing a ceramic heater element, comprising the steps of:

mixing a $Si_3N_4$ powder with an $Al_2O_3$powder, an AlN powder and a powder of a sintering aid comprising $Y_2O_3$ to obtain a powder mixture in which the total of $Si_3N_4$, $Al_2O_3$ and AlN amounts to 90-98 wt % with proviso that the ratio of $(Al_2O_3.+AlN)$ to $Si_3N_4$ is in the range from 0.O2 to 0.08 by weight and that the ratio of $Al_2O_3$ to AlN is in the range from 0.2 to 2.0;

compacting said powder into a desirably shaped body with insertion of a resistance heating wire to embed the wire in the shaped body; and sintering the shaped body in a nonoxidizing atmosphere at a temperature in the range from 1600° to 2100° C.

6. A method according to claim 5, wherein the shaped body is sintered in a mold under pressure.

7. A method according to claim 5, wherein said sintering aid further comprises at least one other rare earth element oxide.

8. A method according to claim 5, wherein the material of the heating wire is selected from the group consisting of tungsten, molybdenum and rhenium, and their alloys and mixtures, tungsten carbide, molybdenum carbide and rhenium carbide.

* * * * *